US012623139B2

(12) United States Patent
Zurita

(10) Patent No.: US 12,623,139 B2
(45) **Date of Patent: *May 12, 2026**

(54) GAME TILE SHUFFLER

(71) Applicant: Yesmin Zurita, West Palm Beach, FL (US)

(72) Inventor: Yesmin Zurita, West Palm Beach, FL (US)

( * ) Notice: Subject to any disclaimer, the term of this patent is extended or adjusted under 35 U.S.C. 154(b) by 1045 days.

This patent is subject to a terminal disclaimer.

(21) Appl. No.: 17/676,781

(22) Filed: Feb. 21, 2022

(65) Prior Publication Data

US 2022/0176233 A1 Jun. 9, 2022

Related U.S. Application Data

(63) Continuation of application No. 16/519,526, filed on Jul. 23, 2019, now Pat. No. 11,253,775.

(60) Provisional application No. 62/703,696, filed on Jul. 26, 2018.

(51) Int. Cl.

| | |
|---|---|
| ***A63F 7/34*** | (2006.01) |
| ***A63F 3/00*** | (2006.01) |
| ***A63F 9/20*** | (2006.01) |
| ***A63F 11/00*** | (2006.01) |

(52) U.S. Cl.

CPC ..... *A63F 7/34* (2013.01); *A63F 2003/00747* (2013.01); *A63F 9/20* (2013.01); *A63F 2009/205* (2013.01); *A63F 11/0002* (2013.01); *A63F 2011/0006* (2013.01)

(58) Field of Classification Search

CPC ..... A63F 7/34; A63F 9/20; A63F 11/0002; A63F 2009/205; A63F 2011/0006

USPC ..... 273/293, 149 R, 144 R, 144 A, 144 B

See application file for complete search history.

(56) References Cited

U.S. PATENT DOCUMENTS

| | | | | | |
|---|---|---|---|---|---|
| 4,219,200 | A * | 8/1980 | Takahashi | A63F 9/28 | 273/309 |
| 4,264,074 | A * | 4/1981 | Sobajima | A63F 9/28 | 273/309 |
| 4,534,561 | A * | 8/1985 | Okuno | A63F 9/28 | 273/309 |
| 4,834,385 | A * | 5/1989 | Jackson | G07C 15/001 | 273/144 A |
| 4,846,476 | A * | 7/1989 | Hanna | G07C 15/001 | 273/144 A |
| 4,877,246 | A * | 10/1989 | Kropkowski | A63F 7/048 | 193/17 |
| 4,892,310 | A * | 1/1990 | Patterson | G07C 15/001 | 273/DIG. 30 |
| 5,435,556 | A * | 7/1995 | Rice | A63F 7/048 | 273/142 G |

(Continued)

*Primary Examiner* — Joseph B Baldori

(74) *Attorney, Agent, or Firm* — A. Robert Weaver; The Brickell IP Group, PLLC

(57) ABSTRACT

A game tile shuffler may include a tile container and a tile dispenser. Game tiles may pass between the tile container and the tile dispenser. The tile dispenser may include a chute opening and a tunnel that may split into multiple directions. A tunnel door may direct the game tiles between the multiple directions. The tile dispenser may be capable of identifying individual game tiles prior to dispensing. The game tile shuffler may be operable between a shuffle mode, whereby game tiles are circulated through the device, and a dispensing mode, whereby game tiles pass through the tunnel.

18 Claims, 8 Drawing Sheets

(56) References Cited

U.S. PATENT DOCUMENTS

| | | | | |
|---|---|---|---|---|
| 6,113,100 | A * | 9/2000 | Mu | A63F 9/28 273/309 |
| 6,120,024 | A * | 9/2000 | Lind | G07C 15/00 273/144 R |
| 8,235,388 | B1 * | 8/2012 | Itkis | G07C 15/001 463/19 |
| 9,737,791 | B1 * | 8/2017 | Tripp | A63F 3/062 |
| 11,253,775 | B2 * | 2/2022 | Zurita | A63F 7/34 |
| 2015/0069701 | A1 * | 3/2015 | Lee | A63F 3/00895 273/149 R |
| 2018/0056178 | A1 * | 3/2018 | Tseng | A63F 11/0002 |

* cited by examiner

GAME TILE SHUFFLER

CROSS REFERENCE TO RELATED APPLICATIONS

This application is a continuation of U.S. application Ser. No. 16/519,526 filed Jul. 23, 2018, which claims priority to U.S. Provisional Patent Application No. 62/703,696 filed on Jul. 26, 2018, the entire contents of which are incorporated by reference herein.

FIELD OF THE DISCLOSURE

This disclosure relates generally to tile shufflers and, more particularly, a shuffler for dispensing tiles used in games.

BACKGROUND

Numerous games utilize tiles that contain letters, numbers, or symbols as part of gameplay. Mahjong and Dominoes, for instance, both involve placing tiles on a game surface in accordance with their respective rules. Scrabble® is an example board game which incorporates game tiles each having letters with associated point values. In each example, the game involves multiple players selecting these game tiles at random. Cheating can be rampant, however, from players who employ deceptive tactics to knowingly select particular tiles rather than choosing a game tile at random. For example, Scrabble® players may blindly select letter game tiles from a bag—but a cheating player may attach a small tool to their finger in order to feel a marking on the tile so as to identify what letter is on the tile so as to intentionally select higher value tiles. A shuffler, which would mix and randomly distribute game tiles, would thus curtail this and similar methods of cheating.

BRIEF SUMMARY OF THE DISCLOSURE

The following presents a simplified summary of the disclosure in order to provide a basic understanding of some aspects of the invention. This summary is not an extensive overview of every embodiment disclosed herein. It is intended to neither identify key or critical elements of the various embodiments nor delineate the scope of the disclosure. Its sole purpose is to present some concepts of the disclosure, in accordance with the various embodiments disclosed herein, in a simplified form as a prelude to the more detailed description that is presented later.

In one embodiment of the disclosure, a game tile shuffler may include a tile container and a tile dispenser. The tile container may be capable of receiving a plurality of game tiles. The tile dispenser may include a chute and a dispenser tunnel. The chute may be positioned to receive game tiles from the belt and dimensioned to pass the game tiles along the chute and into the tile container, the chute including a chute opening. The dispenser tunnel may extend from the chute opening to a first tunnel opening. The game tile shuffler may be operable to selectively open the chute opening, with a shuffling mode defined by the chute opening being blocked thereby passing the plurality of game tiles within the chute to the tile container, and a dispensing mode defined by the chute opening being accessible thereby capable of passing the plurality of game tiles within the chute to the dispenser tunnel.

In another embodiment, a game tile shuffler may include a tile container capable of receiving a plurality of game tiles and a tile dispenser. The tile dispenser may include a chute positioned to receive the at least one of the plurality of game tiles from the belt and dimensioned to pass the at least one of the plurality of game tiles along the chute and into the tile container, the chute including a chute opening, a dispenser tunnel extending from the chute opening to a first tunnel opening, and a tile selector including a chute portion and a tile dispensing portion, the chute portion aligned with the chute and having a chute portion hole positioned over the chute opening, and the tile dispensing portion laterally moveable across the chute portion. The game tile shuffler may be operable to selectively move the tile dispensing portion between a shuffle position and a dispensing position. The plurality of game tiles may be capable of passing through the chute portion in the shuffle position and the plurality of game tiles may be capable of passing through the chute opening and the chute portion hole in the dispensing position.

The following description and the annexed drawings set forth certain illustrative aspects of the embodiments of the disclosure. These aspects are indicative, however, of but a few of the various ways in which the principles of the disclosure may be employed and the various embodiments are intended to include all such aspects and their equivalents. Other advantages and novel features will become apparent from the following description when considered in conjunction with the drawings.

DETAILED DESCRIPTION

Figure 1:
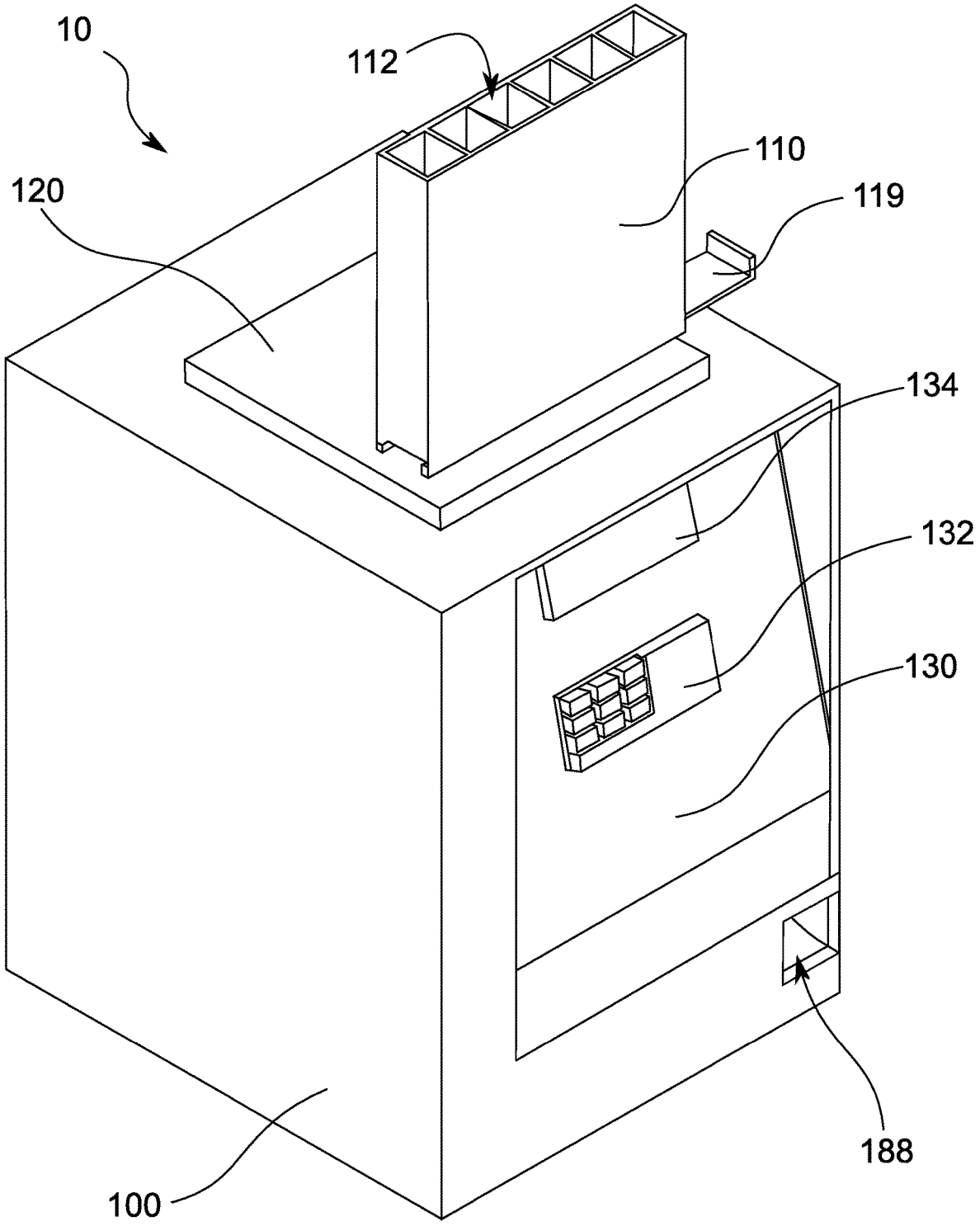
FIG. 1 illustrates a top-front-left perspective view of an embodiment of a game tile shuffler.
Figure 2:
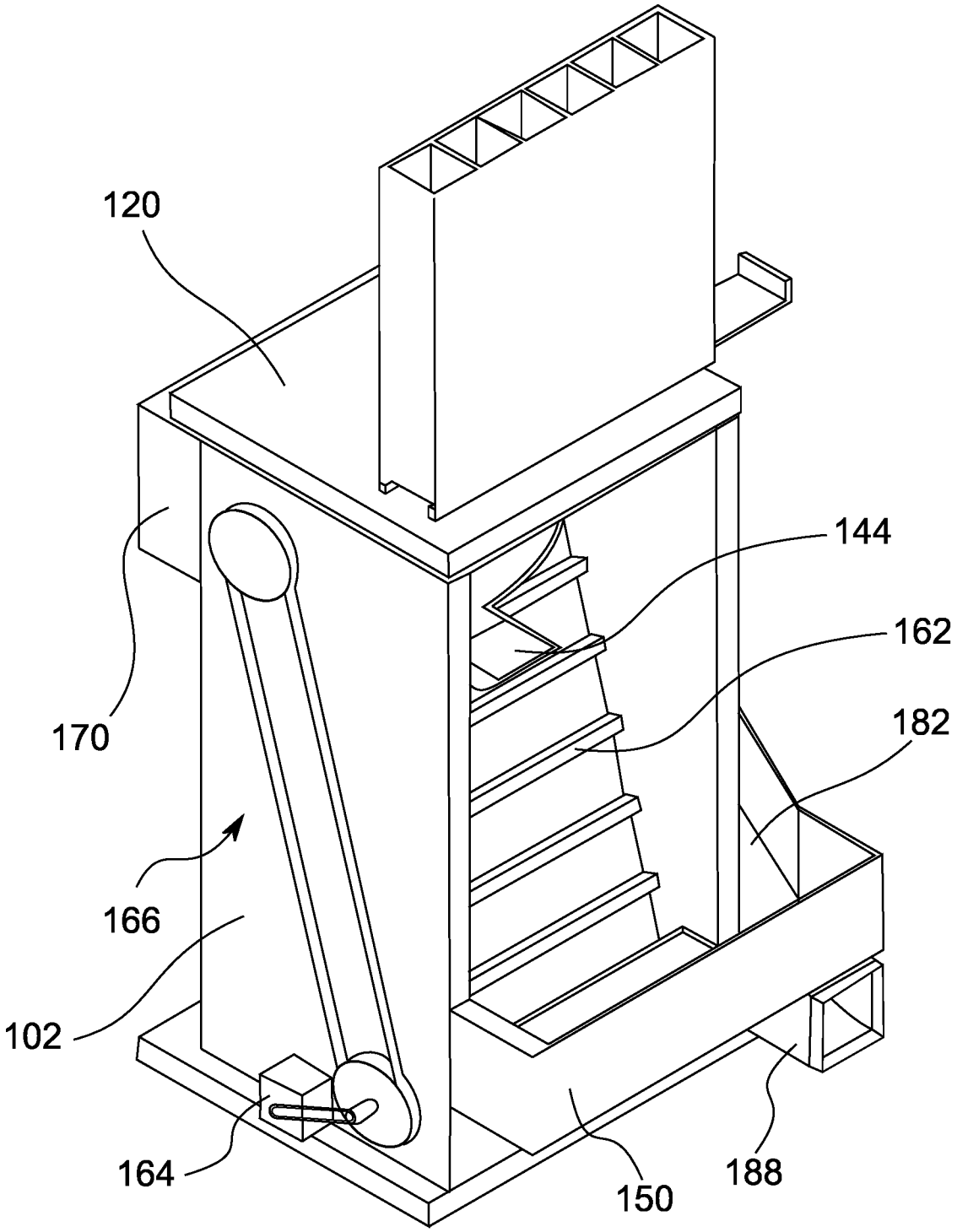
FIG. 2 illustrates a top-front-left perspective view of the game tile shuffler of FIG. 1 with the front panel and case removed.
Figure 3:
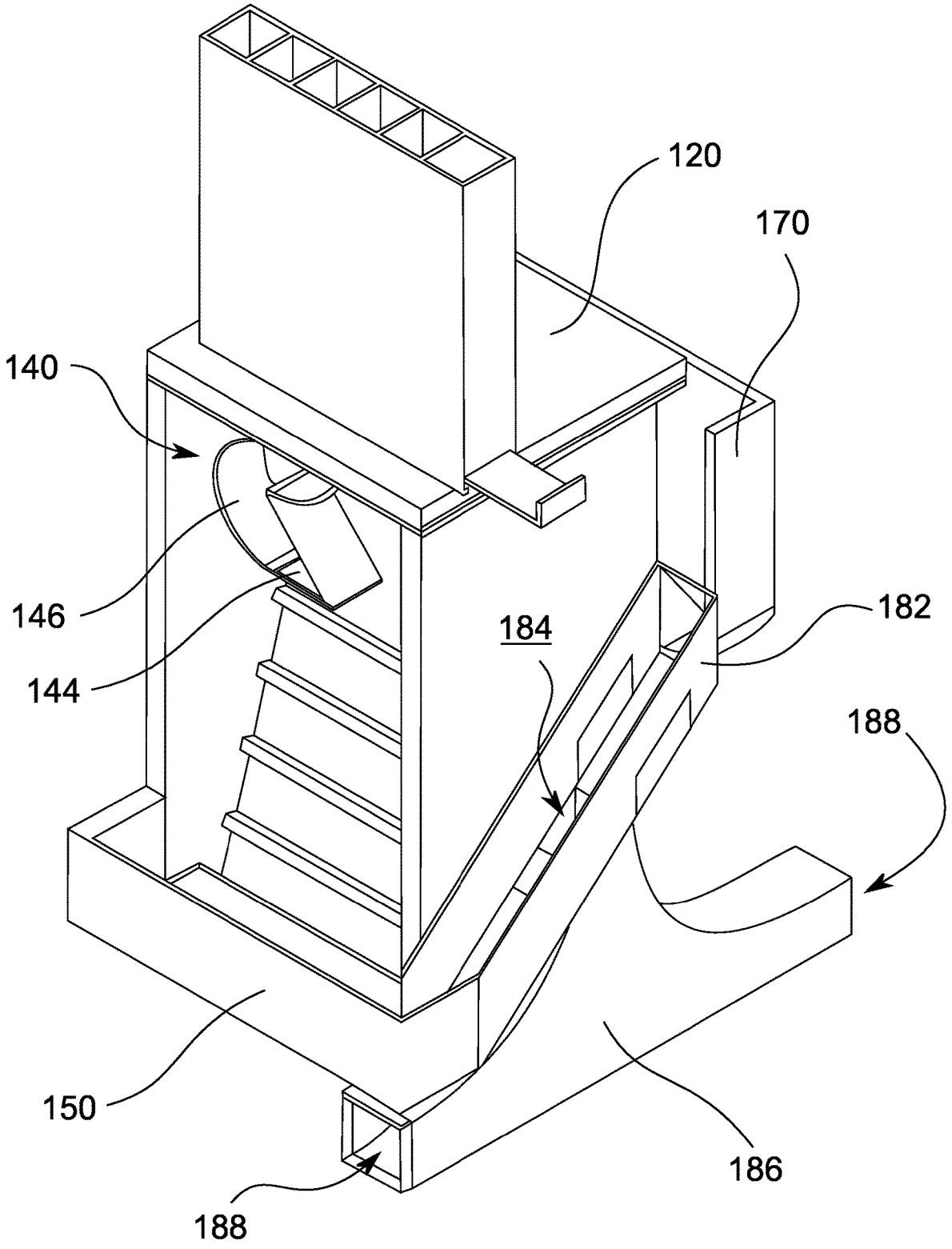
FIG. 3 illustrates a top-front-right perspective view of the game tile shuffler of FIG. 1 with the front panel and case removed.
Figure 4:
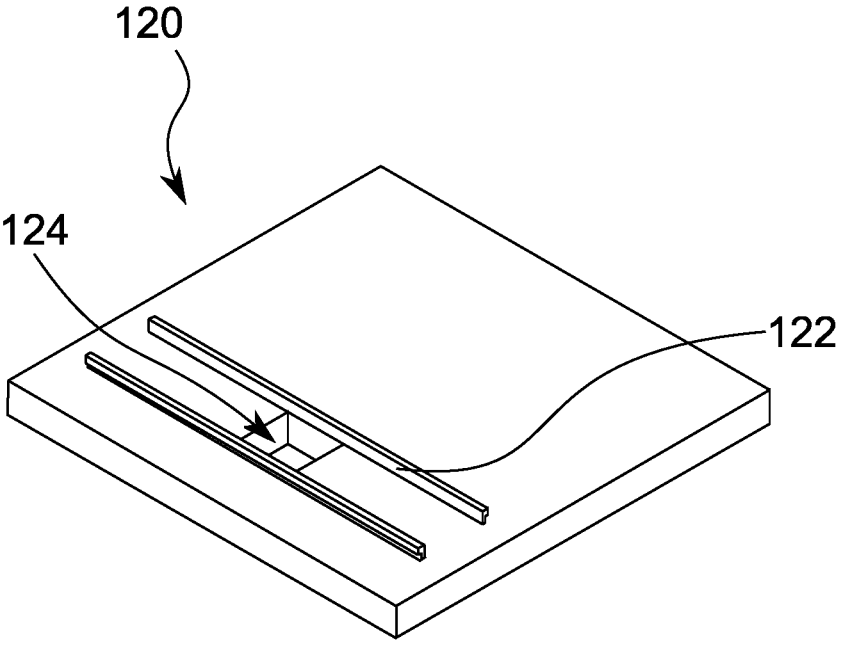
FIG. 4 illustrates a top-front-right perspective view of a support loader from the game tile shuffler of FIG. 1.
Figure 5:
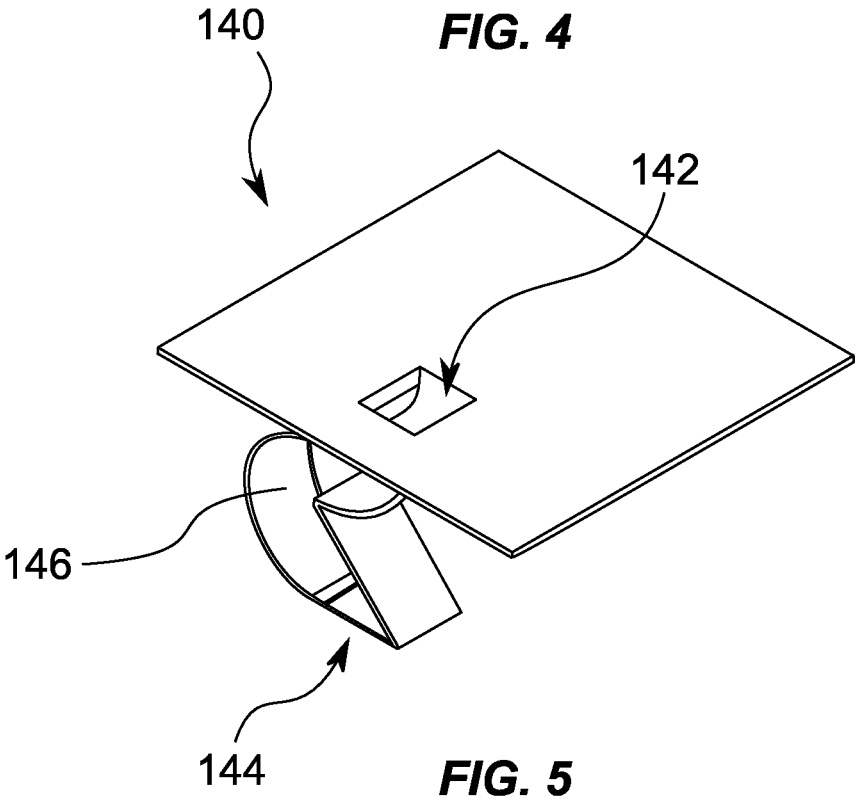
FIG. 5 illustrates a top-front-right perspective view of a tile counter from the game tile shuffler of FIG. 1.
Figure 6:
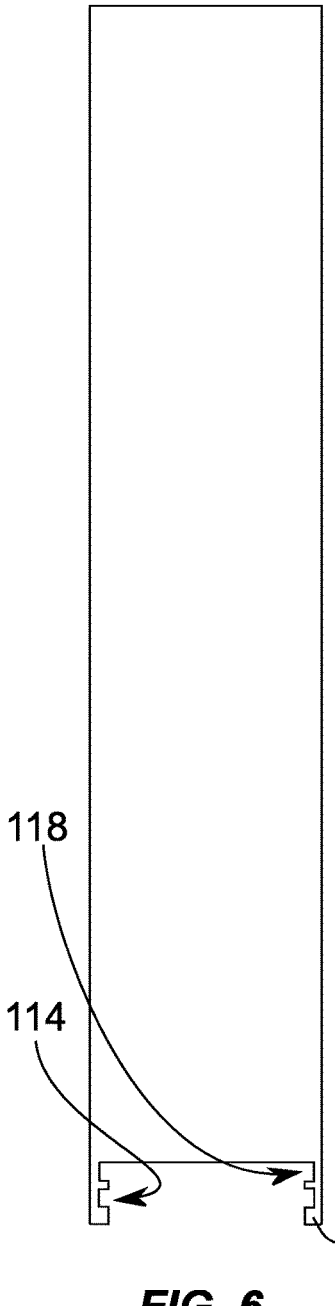
FIG. 6 illustrates a side view of a tile loader from the game tile shuffler of FIG. 1.
Figure 7:
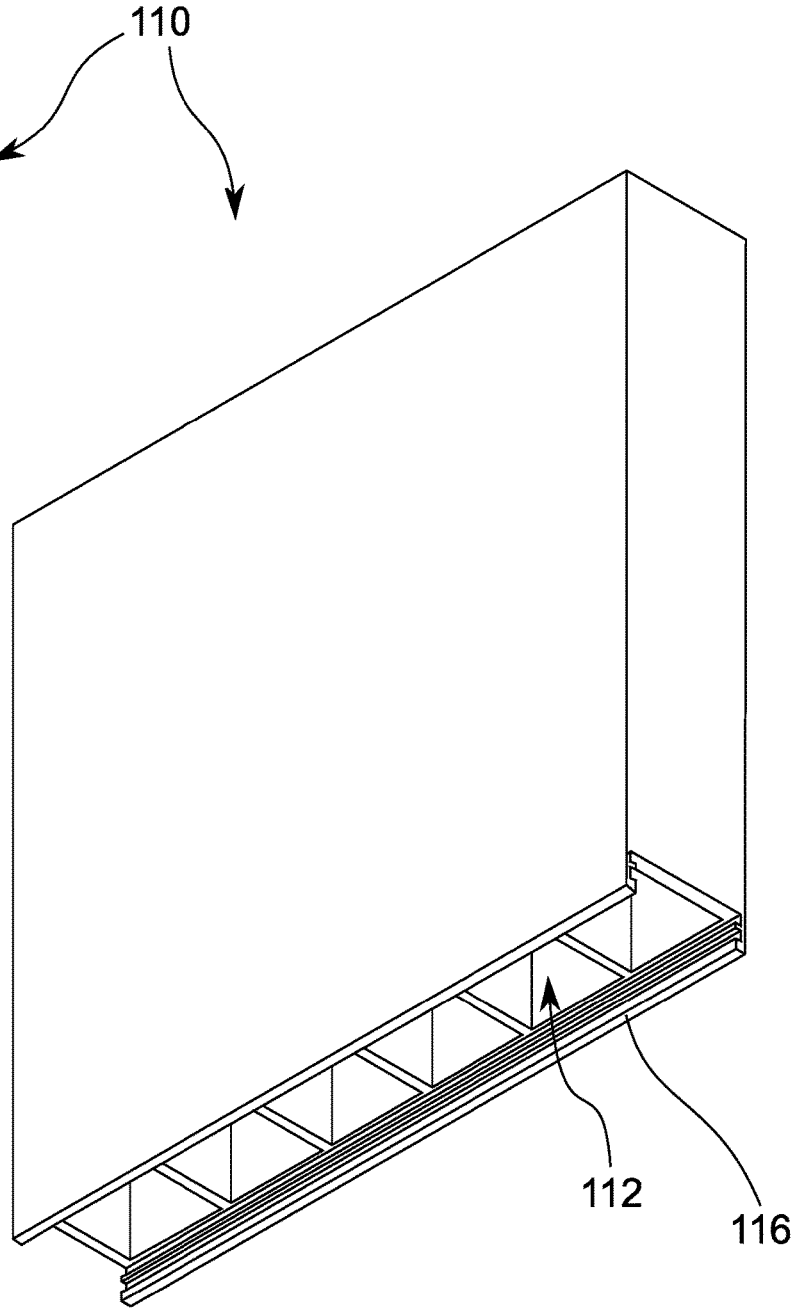
FIG. 7 illustrates a bottom-front-right perspective view of a tile loader from the game tile shuffler of FIG. 1.
Figure 8:
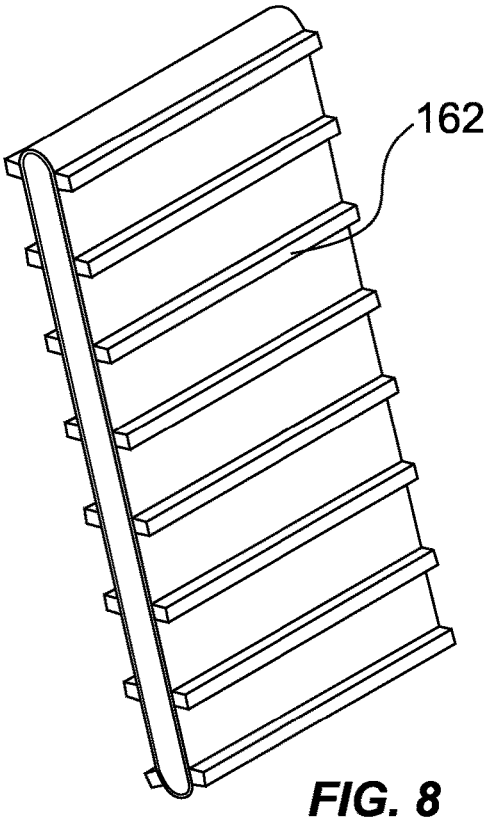
FIG. 8 illustrates a top-front-left perspective view of a belt from the game tile shuffler of FIG. 1.
Figure 9:
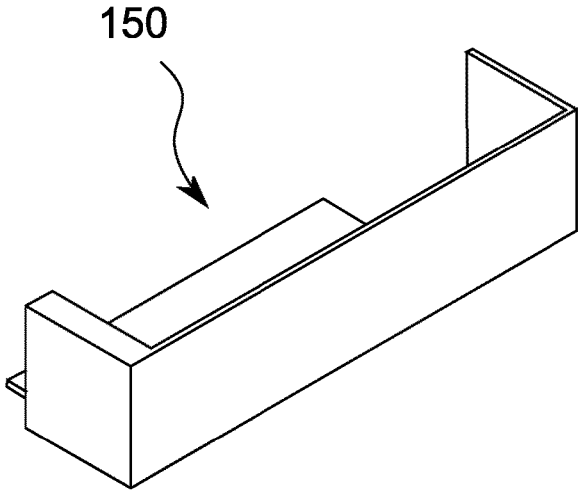
FIG. 9 illustrates a top-front-left perspective view of a tile container from the game tile shuffler of FIG. 1.
Figure 10:
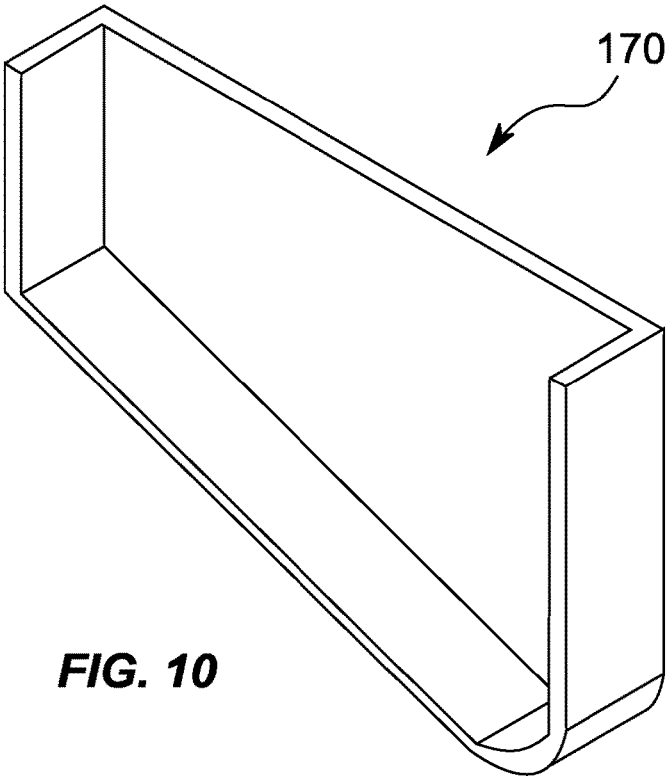
FIG. 10 illustrates a top-front-right perspective view of a back container from the game tile shuffler of FIG. 1.
Figure 11:
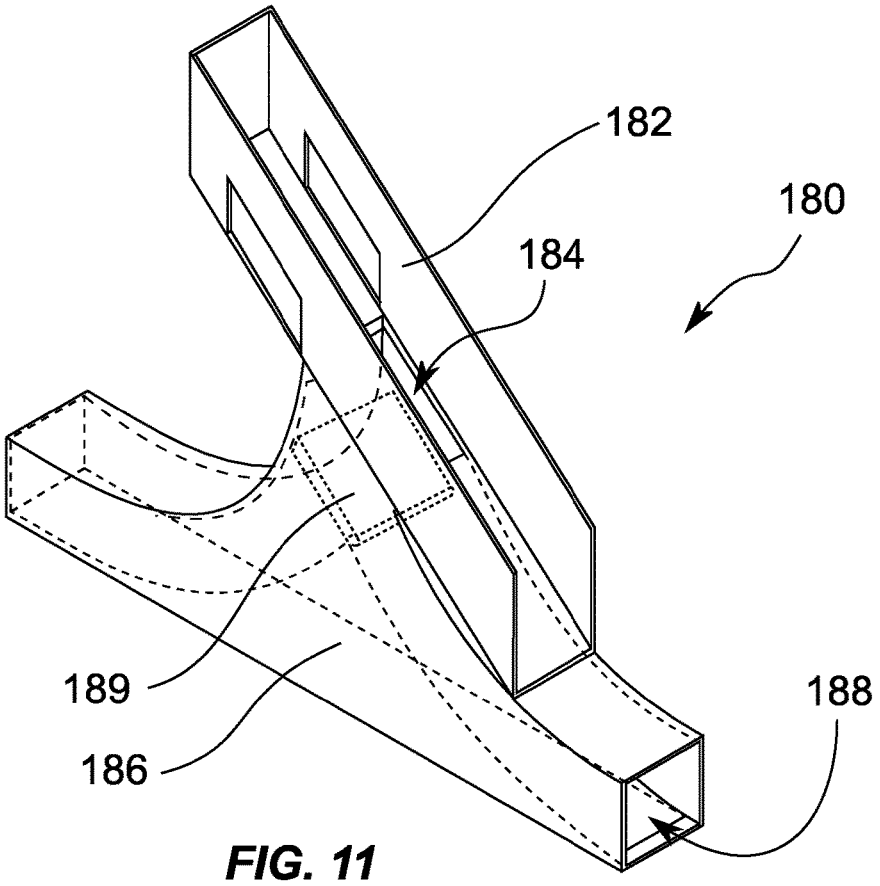
FIG. 11 illustrates a top-front-left perspective view of a tile dispenser from the game tile shuffler of FIG. 1, with hidden structure shown in broken line.

The following detailed description and the appended drawings describe and illustrate some embodiments of the disclosure for the purpose of enabling one of ordinary skill in the relevant art to make and use these embodiments. As such, the detailed description and illustration of these embodiments are purely illustrative in nature and are in no way intended to limit the scope of the disclosure in any manner. It should also be understood that the drawings are not necessarily to scale and in certain instances details may have been omitted, which are not necessary for an understanding of the embodiments, such as details of fabrication and assembly. In the accompanying drawings, like numerals represent like components.

In one embodiment of the disclosure, a game tile shuffler may include a tile loader, a tile container, a belt, and a tile dispenser. The tile loader may be capable of holding a plurality of game tiles. The tile container may be capable of receiving the plurality of game tiles from the tile loader. The belt may include a shelf dimensioned to carry at least one of the plurality of game tiles, the belt positioned proximate the tile container, and the belt rotatable so as to capture the at least one of the plurality of game tiles from the tile container and carry the at least one of the plurality of game tiles in the direction of the belt's rotation. The tile dispenser may include a chute and a dispenser tunnel. The chute may be positioned to receive game tiles from the belt and dimensioned to pass the game tiles along the chute and into the tile container, the chute including a chute opening. The dispenser tunnel may extend from the chute opening to a first tunnel opening. The game tile shuffler may be operable to selectively open the chute opening, with a shuffling mode defined by the chute opening being blocked thereby passing the plurality of game tiles within the chute to the tile container, and a dispensing mode defined by the chute opening being accessible thereby capable of passing the plurality of game tiles within the chute to the dispenser tunnel.

In further embodiments, the dispenser tunnel may split to either the first tunnel opening or a second tunnel opening, and the dispenser tunnel includes a tunnel door to selectively block the dispenser tunnel from the first or second tunnel opening. The tile loader may include a plurality of tile channels each dimensioned to receive the at least one of the plurality of game tiles. The game tile shuffler may include a support loader having a pair of rails. The tile loader may include a plurality of rail slots each provided in a pair of bottom walls extending downward from sides of the tile loader, and each rail slot is engageable with one of the pair of rails. A tile loader cover may be positionable to block a bottom end of the tile channels, and each of the pair of bottom walls may include a cover slot dimensioned to receive the tile loader cover. The game tile shuffler may include a tile counter having a tile counter entrance hole, a tile counter exit hole, and a tile counter conduit extending between the tile counter entrance and exit holes. The tile counter entrance hole may be positioned proximate the tile loader and the tile counter exit hole may be positioned over the tile container. The tile counter conduit may include at least one bend. The game tile shuffler may include a back container positioned to directly receive game tiles carried by the belt, and the back container having a sloped floor terminating at an entrance to the chute.

An embodiment of a game tile shuffler may include a tile loader capable of holding a plurality of game tiles, a tile container capable of receiving the plurality of game tiles from the tile loader, a belt capable of capturing and carrying at least one of the plurality of game tiles, and a tile dispenser. The tile dispenser may include a chute positioned to receive the at least one of the plurality of game tiles from the belt and dimensioned to pass the at least one of the plurality of game tiles along the chute and into the tile container, the chute including a chute opening, a dispenser tunnel extending from the chute opening to a first tunnel opening, and a tile selector including a chute portion and a tile dispensing portion, the chute portion aligned with the chute and having a chute portion hole positioned over the chute opening, and the tile dispensing portion laterally moveable across the chute portion. The game tile shuffler may be operable to selectively move the tile dispensing portion between a shuffle position and a dispensing position. The plurality of game tiles may be capable of passing through the chute portion in the shuffle position and the plurality of game tiles may be capable of passing through the chute opening and the chute portion hole in the dispensing position.

In additional embodiments, the dispensing portion may include a dispensing portion entrance and a dispensing portion exit. The dispensing position may include a second and third position, whereby the dispensing portion entrance may be aligned with the chute portion in the second position and the dispensing portion exit is aligned with the chute opening in the third position. The chute portion may include a projection and the dispensing portion includes a gap dimensioned to receive the projection and positioned proximate the dispensing portion entrance, the projection entering into the gap as the projecting portion moves between the second and third position. The dispensing portion may include a sensor positioned proximate the dispensing portion entrance and operable to identify the at least one of the plurality of game tiles. The dispensing portion may include an end post which contacts a side of the chute portion as the dispensing portion is in the shuffle position. The dispensing portion entrance may only accommodate one of the plurality of game tiles at a time, and the one of the plurality of game tiles must be passed to the dispensing portion exit before the dispensing portion entrance can receive another one of the plurality of game tiles. The dispensing portion may include a sensor to identify the one of the plurality of game tiles positioned within the dispensing portion entrance. The chute portion may include a pair of chute portion wings projecting into the chute portion. The dispenser tunnel may split to either the first tunnel opening or a second tunnel opening, and the dispenser tunnel may include a tunnel door to selectively block the dispenser tunnel from the first or second tunnel opening.

With reference now to the Figures, a game tile shuffler 10 may include a case 100 with a tile loader 110 mounted on a topside of the case. The tile loader 110 may be dimensioned to hold a plurality of game tiles. In the illustrated embodiment, the tile loader 110 includes a plurality of tile channels 112 internally running the length of the tile loader 110 and dimensioned to receive game tiles of corresponding size, such as square for Scrabble® or rectangular for dominos or MahJong. Tile loader 110 may be mounted on a support loader 120, and support loader 120 may be mounted on the topside of case 100. Support loader 120 may include a pair of rails 122 dimensioned to mate with rail slots 114 provided on the bottom side of tile loader 110. Rails slots 114 may be defined along a pair of bottom walls 116 extending downward from side walls of the tile loader. In addition to rail slots 114, bottom walls 116 may further include cover slots 118 dimensioned to slidably receive an elongate tile loader cover 119, which can selectively cover the bottom side openings to tile channels 112. A support loader hole 124 may be provided between rails 122 and dimensioned to receive game tiles falling therethrough. A topside hole in case 100 may be aligned with support loader hole 124 to permit game tiles to pass into case 100 and the interior components of game tile shuffler 10 in accordance with embodiments described herein.

A case cover 130 may be attached to case 100, and case cover 130 may include a keypad 132 or other mechanisms of user input such as a visual scanner, fingerprint reader, touchscreen, credit or debit card reader, key insert, or other known or to be discovered mechanisms, electronic or analog, to facilitate a user's entry of commands. Front cover 130 may further include a display screen 134 or other mechanisms of data output such as a speakers or other known or to be discovered mechanisms, electronic or analog, to permit the communication of output data to a user. Multiple covers, each having a keypad 132 and/or screen 134, are contemplated. For example, in the illustrated embodiment a case cover 130 with a keypad 132 and screen 134 are shown on the front side of the machine, and another cover 130 with a keypad 132 and screen 134 may be provided on the opposing, back side of the machine. In this regard, two users sitting on opposite sides (i.e. the front and back sides) of game tile shuffler 10 may each operate the machine through keypad 132 and screen 134.

Through keypad 132 and screen 134, one or more users may operate components of game tile shuffler 10 as described herein. For example, a user could selectively request the game tile shuffler dispense six tiles, which would activate game tile shuffler 10 as described herein resulting in six tiles being dispensed to the user positioned proximate the front side of the machine. A second user could then selectively request the game tile shuffler to dispense two tiles, which would activate game tile shuffler as described herein resulting in two tiles being dispensed to the second user positioned proximate the back side of the machine. This may continue until the all game tiles have been dispensed. Display screen 134 may indicate user data, such as the user's name and game statistics. Display screen 134 may also indicate game tile data, such as the number of game tiles yet to be dispensed as well as which types of game tiles remain or have already been dispensed.

A variety of mechanisms are contemplated within the disclosure to transfer game tiles from tile loader 110 to within case 100. In one embodiment, tile counter 140 may be removed thereby permitting game tiles to naturally fall from tile channels 112 onto support loader 120, and the fallen game tiles may slide towards support loader hole 124 by way of incline of the top surface support loader 120 between rails 122. Support loader 120 could also be moved across rails 122 so as to position the bottom openings of each tile channel 112 over support loader hole 124.

Game tiles may fall from tile channels 112 through support loader hole 124 into a tile counter 140 provided within case 100. Tile counter 140 may include a tile counter entrance hole 142 aligned with support loader hole 124, and a tile counter exit hole 144 positioned over a tile container 150. Game tiles may pass from entrance hole 142 to exit hole 144 through a tile counter conduit 146, which may weave or snake so as to encourage shuffling of game tiles as they pass through. A sensor may be provided at any point along conduit 146 between entrance hole 142 and exit hole 144. This sensor may be operational to count the number of tiles passing through tile counter 140. In one embodiment the sensor may be a visual sensor, such as a motion sensor, so as to detect the passing of each tile.

Once through tile counter 140, game tiles may fall onto tile container 150 and moved towards ladder or belt 160, for instance by slopping a floor or base surface 152 of tile container 150. An arm or other push mechanism may be provided to urge game tiles towards belt 160.

Belt 160 may include a plurality of spaced ledges or shelves 162 dimensioned to capture a plurality of game tiles resting in tile container 150. Belt 160 may rotate so as to transport tiles upwards that are resting on the shelves 162. Belt 160 may rotate as a result of a motor 164 and pulley 166 system.

Once at the top of the belt 160, game tiles may be ejected into a back container 170, which may have a base surface that is sloped towards a tile dispenser 180. Tile dispenser 180 may include a chute 182 connected between back container 170 and tile container 150. Within chute 182 may be a chute opening 184 leading to a dispenser tunnel 186. Dispenser tunnel 186 may split into a plurality of directions. In the illustrated embodiment, dispenser tunnel 186 splits into two directions, one towards the front of game tile shuffler 10 and one towards the back of game tile shuffler 10. Further embodiments may the split the tunnel in additional directions, particularly for use with games having more than two players. Game tiles falling through dispenser tunnel 186 may emerge through a tunnel opening 188 to be received by a user. A container or bag (not illustrated) may be attached to the opening to ensure observers may not see the tiles dispensed. A tunnel door 189 may be operable to direct game tiles towards the desired direction with the tunnel 186. In the illustrated embodiment, tunnel door 189 is positioned proximate where tunnel 186 splits, and tunnel door 189 is pivotable between a first and second position, with the first position permitting game tiles to fall in the first direction while the second position permits the game tiles to fall in the second direction.

A tile selector 190 may be coupled with chute 182 proximate the chute opening 184. Tile selector may include a chute portion 191 and a dispensing portion 192 that moves laterally across the chute portion 192 between a first and second position. Chute portion 191 may include chute portion wings 191*a* projecting into chute portion 191 so as to align game tiles as they pass through chute portion 191 towards dispensing portion 192. An edge opening 193 may be provided on the chute portion 191 to permit dispensing portion 192 to move laterally past the edge of chute portion 191. Chute portion 191 may include a projection 194 provided within edge opening 193 Dispensing portion 192 may also include a dispensing portion entrance 195 and a dispensing portion exit 196. The entrance 195 and exit 196 may be adjacent one another. A gap 197 may be provided proximate to entrance 195 with dimensions conforming to projection 194 such that projection 194 may enter gap 197. Dispensing portion 192 may also include one or more end posts 199, which may be positioned to permit the projection 194 to pass beyond towards gap 197. For example, the illustrated embodiment shows two end posts 199 which projection 194 can pass between.

Figure 12:
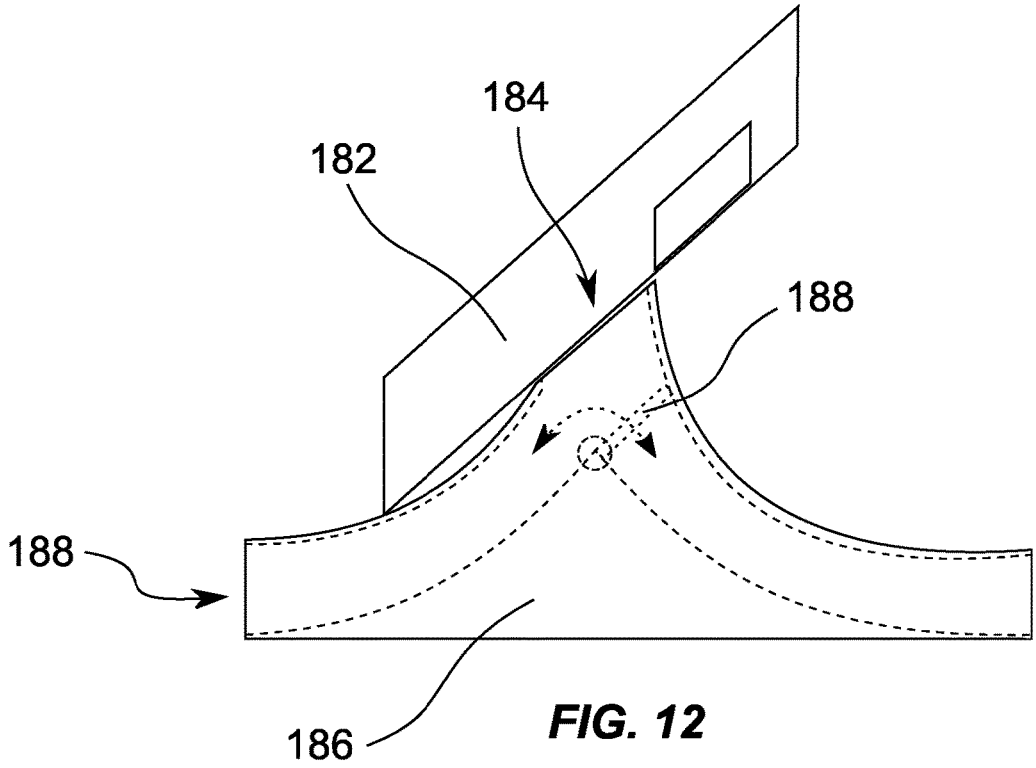
FIG. 12 illustrates a right side view of a tile dispenser from the game tile shuffler of FIG. 1, with hidden structure shown in broken lines.
Figure 13:
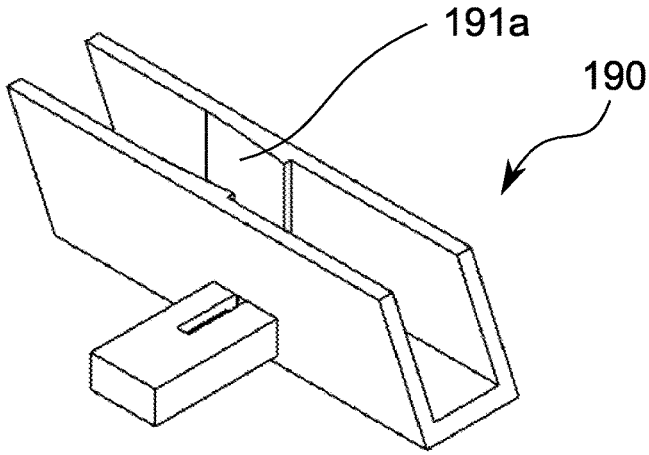
FIG. 13 illustrates a top-front-right perspective view of an embodiment of a tile selector for use with a game tile shuffler.
Figure 14:
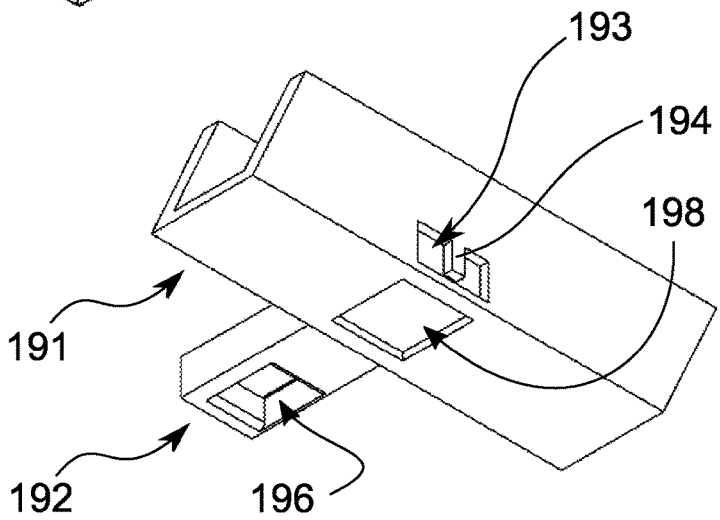
FIG. 14 illustrates a bottom-back-right perspective of the tile selector of FIG. 13.
Figure 15:
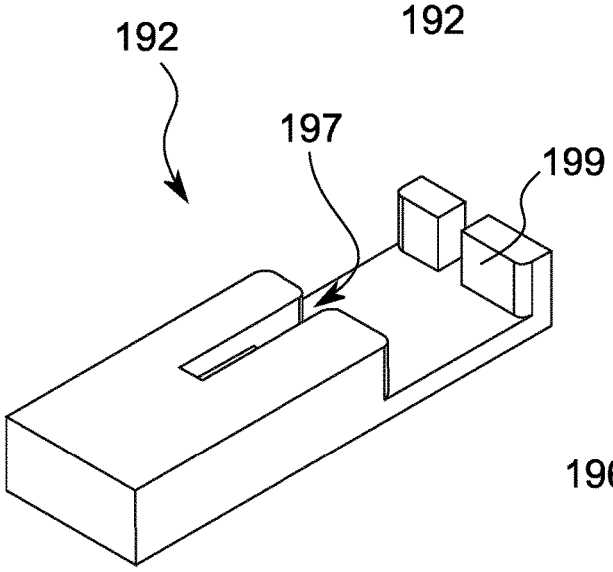
FIG. 15 illustrates a top-front-right perspective view of a tile dispensing portion of the tile selector of FIG. 13.
Figure 16:
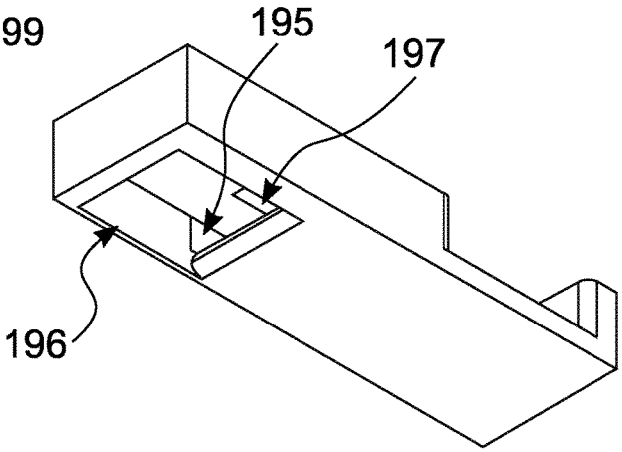
FIG. 16 illustrates a bottom-front-right perspective view of a tile dispensing portion of the tile selector of FIG. 13.

Tile selector 190 may operate by moving dispensing portion 192 laterally across chute portion 191. In a first position, as illustrated FIGS. 12 and 13, dispensing portion 192 may be positioned with the entrance 195 and exit 196 outside of the chute portion 191. Game tiles may be permitted to pass through chute portion in this first position, which may be referred to as a shuffle position. Ends posts 199 may contact a side of chute portion 191 to prevent the dispenser portion 192 from dislodging. In a second position, dispensing portion 192 may be laterally positioned such that entrance 195 is aligned with chute portion 192 thereby permitting a game tile from to pass into entrance 195. Due to the dimensions of the entrance, only one game tile may be within entrance 195 at a time. In a third position, dispensing portion 192 may be laterally positioned such that exit 196 is aligned with the chute portion hole 198. In moving from the second to third position, projection 194 may contact a game tile within entrance 195 and push the game tile into exit 196, which would thereby fall into chute portion hole 198 and into chute opening 184 and dispenser tunnel 186. When dispensing portion 192 is in the described second and third positions, which may be generally referred to as a dispensing position, game tiles may not pass through chute portion 191. When dispensing portion 192 is in the described first position, game tiles may pass through chute portion 191 along chute 182 and ultimately into tile container 150. A sensor may be also be provided proximate to entrance 195 so as to scan or identify the tile within entrance 195.

A shell 102 may be provided within case 100 in order to support one or more of the structural components described herein. For example, in the illustrated embodiment tile counter 140 is attached to the underside surface of the top of shell 102, tile container 150 is attached to the front side of shell 102, belt 160 is positioned within shell 102 with the motor 164 and pulley 166 system attached to the left side of shell 102, back container 170 is attached to the back of shell 102, and tile dispenser 180 is attached to the right side of shell 102.

A computer, including at least a computer processor, memory, and electronic circuitry, may be provided to operate the game tile shuffler 10 as described herein. For example, the computer may be in communication with the sensors described herein in order to identify the number of game tiles remaining, including which types of tiles remain within the shuffler 10 and which types of tiles have been dispensed. Computer may also be in communication with the one or more displays 132 and keypads 134. Operating software may be installed on the computer system. The software may include a sensor module for communicating with the sensors described herein. A dispensing module may also be provided so as to control the number of tiles to be selectively dispensed as instructed by a user. In one embodiment, Arduino software may be utilized to prepare solutions for accomplishing software modules.

The game tile shuffler 10 may also be switched between a dispensing mode and a shuffle mode. Shuffle mode may occur when chute opening 182 is blocked, such as when tile selector 190 is in its described first position, thereby permitting tiles to pass from the back container 170 to tile container 150. Dispensing mode may occur when chute opening 182 is open, such as when the tile selector is passing between its second and third positions, thereby permitting game tiles to pass through to the users.

A person of ordinary skill in the art should appreciate that term "game tiles" should not be limited to cuboid objects such as dominos or Scrabble® tiles. For example, in some embodiments game tile shuffler structural components may be dimensioned such that the game tiles may be spherical or cylindrical objects in order to utilize game tile shuffler in the context of randomizing the selection of bingo balls or lottery balls, or cylindrical game pieces. Other normal and abnormal dimensions for "game tiles" are contemplated with the disclosure.

The descriptions set forth above are meant to be illustrative and not limiting. Various modifications of the embodiments, in addition to those described herein, will be apparent to those skilled in the art from the foregoing description. Such modifications are also intended to fall within the scope of the concepts described herein. Each patent, patent application and publication cited or described in this document are hereby incorporated herein by reference, in their entireties.

The foregoing description of possible implementations consistent with the present disclosure does not represent a comprehensive list of all such implementations or all variations of the implementations described. The description of some implementation should not be construed as an intent to exclude other implementations. For example, artisans will understand how to implement the embodiments in many other ways, using equivalents and alternatives that do not depart from the scope of the disclosure. Moreover, unless indicated to the contrary in the preceding description, none of the components described in the implementations are essential to the embodiments disclosed. It is thus intended that the embodiments be considered as illustrative, with a true scope and spirit of the disclosure being indicated by the following claims.

LISTING OF REFERENCES

10 Game Tile Shuffler
100 Case
102 Shell
110 Tile Loader
112 Tile Channels
114 Rail Slots
116 Bottom Walls
118 Cover Slots
119 Tile Loader Cover
120 Support Loader
122 Rail
124 Support Loader Hole
130 Case Cover
132 Keypad
134 Display Screen
140 Tile Counter
142 Tile Counter Entrance Hole
144 Tile Counter Exit Hole
146 Tile Counter Conduit
150 Tile Container
152 Tile Container Floor
160 Belt
162 Ledge
164 Motor
166 Pulley
170 Back Container
180 Tile Dispenser
182 Chute
184 Chute Opening
186 Dispenser Tunnel
188 Tunnel Opening
189 Tunnel Door
190 Tile Selector
191 Chute Portion
**191*a*** Chute Portion Wing
192 Dispensing Portion
193 Edge Opening
194 Projection
195 Dispensing Portion Entrance
196 Dispensing Portion Exit

197 Gap
198 Chute Portion Hole
199 Dispensing Portion End Posts

What is claimed:

1. A game tile shuffler comprising:

a tile container capable of receiving a plurality of game tiles; and a tile dispenser including a chute positioned to receive game tiles from the tile container and dimensioned to pass the game tiles along the chute and back into the tile container, the chute including a chute opening, and a dispenser tunnel extending from the chute opening to a first tunnel opening, wherein the game tile shuffler is operable to selectively open the chute opening, with a shuffling mode defined by the chute opening being blocked thereby capable of passing the plurality of game tiles within the chute to the tile container, and a dispensing mode defined by the chute opening being accessible thereby capable of passing the plurality of game tiles within the chute to the dispenser tunnel.

2. The game tile shuffler of claim 1 further comprising: a belt including a shelf dimensioned to carry at least one of the plurality of game tiles, the belt positioned proximate the tile container, and the belt rotatable so as to capture the at least one of the plurality of game tiles from the tile container and carry the at least one of the plurality of game tiles in the direction of the belt's rotation.

3. The game tile shuffler of claim 2 further comprising a back container positioned to directly receive game tiles carried by the belt, and the back container having a sloped floor terminating at an entrance to the chute.

4. The game tile shuffler of claim 1, wherein the dispenser tunnel splits to either the first tunnel opening or a second tunnel opening, and the dispenser tunnel includes a tunnel door to selectively block the dispenser tunnel from the first or second tunnel opening.

5. The game tile shuffler of claim 1 further comprising a tile loader capable of holding a plurality of game tiles, wherein the tile container receives the plurality of game tiles from the tile loader, and wherein the tile loader includes a plurality of tile channels each dimensioned to receive the at least one of the plurality of game tiles.

6. The game tile shuffler of claim 5 further comprising a support loader having a pair of rails, wherein the tile loader includes a plurality of rail slots each provided in a pair of bottom walls extending downward from sides of the tile loader, and each rail slot is engageable with one of the pair of rails.

7. The game tile shuffler of claim 6 further comprising a tile loader cover positionable to block a bottom end of the tile channels, wherein each of the pair of bottom walls includes a cover slot dimensioned to receive the tile loader cover.

8. The game tile shuffler of claim 5 further comprising:

a tile counter having a tile counter entrance hole, a tile counter exit hole, and a tile counter conduit extending between the tile counter entrance and exit holes, wherein the tile counter entrance hole is positioned proximate the tile loader and the tile counter exit hole is positioned over the tile container.

9. The game tile shuffler of claim 8 wherein the tile counter conduit includes at least one bend.

10. A game tile shuffler comprising:

a tile container capable of receiving a plurality of game tiles; and a tile dispenser including a chute capable of receiving at least one of the plurality of game tiles from the tile container and dimensioned to pass the at least one of the plurality of game tiles along the chute and into the tile container, the chute including a chute opening, a dispenser tunnel extending from the chute opening to a first tunnel opening, and a tile selector including a chute portion and a tile dispensing portion, the chute portion aligned with the chute and having a chute portion hole positioned over the chute opening, and the tile dispensing portion laterally moveable across the chute portion, wherein the game tile shuffler is operable to selectively move the tile dispensing portion between a shuffle position and a dispensing position, wherein the plurality of game tiles are capable of passing through the chute portion in the shuffle position and the plurality of game tiles are capable of passing through the chute opening and the chute portion hole in the dispensing position.

11. The game tile shuffler of claim 10, wherein the dispensing portion includes a dispensing portion entrance and a dispensing portion exit, and wherein the dispensing position includes a second and third position, whereby the dispensing portion entrance is aligned with the chute portion in the second position and the dispensing portion exit is aligned with the chute opening in the third position.

12. The game tile shuffler of claim 11, wherein the chute portion includes a projection and the dispensing portion includes a gap dimensioned to receive the projection and positioned proximate the dispensing portion entrance, the projection entering into the gap as the projecting portion moves between the second and third position.

13. The game tile shuffler of claim 11, wherein the dispensing portion includes a sensor positioned proximate the dispensing portion entrance and operable to identify the at least one of the plurality of game tiles.

14. The game tile shuffler of claim 11, wherein the dispensing portion includes an end post which contacts a side of the chute portion as the dispensing portion is in the shuffle position.

15. The game tile shuffler of claim 11, wherein the dispensing portion entrance can only accommodate one of the plurality of game tiles at a time, and the one of the plurality of game tiles must be passed to the dispensing portion exit before the dispensing portion entrance can receive another one of the plurality of game tiles.

16. The game tile shuffler of claim 15, wherein the dispensing portion includes a sensor to identify the one of the plurality of game tiles positioned within the dispensing portion entrance.

17. The game tile shuffler of claim 11, wherein the chute portion includes a pair of chute portion wings projecting into the chute portion.

18. The game tile shuffler of claim 10, wherein the dispenser tunnel splits to either the first tunnel opening or a second tunnel opening, and the dispenser tunnel includes a tunnel door to selectively block the dispenser tunnel from the first or second tunnel opening.

* * * * *